United States Patent [19]

Schmid

[11] Patent Number: 4,882,817

[45] Date of Patent: Nov. 28, 1989

[54] LOCKING MECHANISM

[76] Inventor: Jean-Phillipe Schmid, Chateau Crausaz, CH-1111 Gollion, Switzerland

[21] Appl. No.: 180,049

[22] Filed: Apr. 11, 1988

[51] Int. Cl.[4] ..... A44B 9/00

[52] U.S. Cl. ..... 24/707.6; 24/103

[58] Field of Search ..... 24/707.6, 706.4, 706, 24/710.8, 572, 573, 49 P, 103, 48, 33 P

[56] References Cited

U.S. PATENT DOCUMENTS

| | | | |
|---|---|---|---|
| 789,862 | 5/1905 | Lilley | 24/706.4 |
| 996,682 | 7/1911 | Taylor | 24/707.6 |
| 1,267,243 | 5/1918 | McDonald | 24/103 |
| 1,283,843 | 11/1918 | Makowski | 24/707.6 |
| 1,336,692 | 4/1920 | Forman | 24/706.4 |
| 1,715,258 | 5/1929 | Tonn | 24/103 |
| 2,285,051 | 6/1942 | Pujol | 24/706.4 |
| 3,460,282 | 8/1969 | Swirsky | 24/573 |
| 4,559,679 | 12/1985 | Downey | 24/573 |

*Primary Examiner*—Victor N. Sakran

*Attorney, Agent, or Firm*—Ross, Howison, Clapp & Korn

[57] ABSTRACT

A locking mechanism is provided for securing two plastic pieces (16) and (20) together. The locking mechanism includes two longitudinal pins (10) and (12) which are secured at one end thereof in the endpiece (16). The other end is tapered and is inserted through channels (30) and (32) into the other endpiece (28). Kinked portions (18) and (20) are provided in the ends of the pins (10) and (12) to increase the effective diameter of the pins such that it is greater than the diameter of the channels (30) and (32). Strain-relief cavities (40) and (42) are provided at the ends of each of the channels (30) and (32), respectively, to receive the respective kinked portions (18) and (20).

4 Claims, 1 Drawing Sheet

FIG. 1
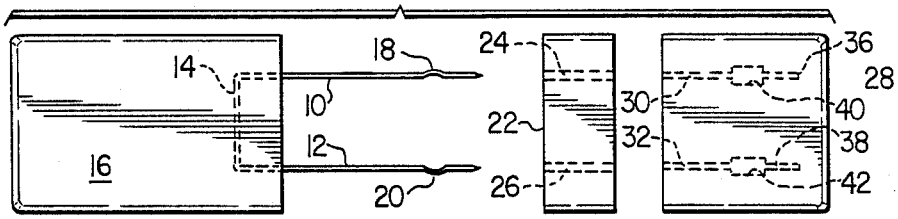
FIG. 2
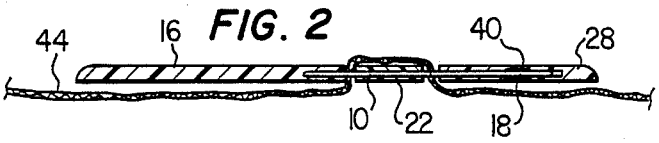
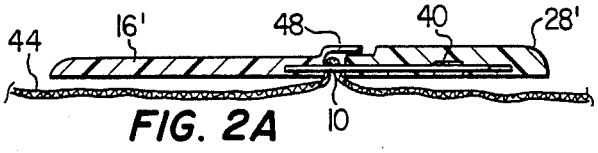
FIG. 2A
FIG. 5
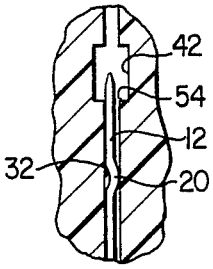
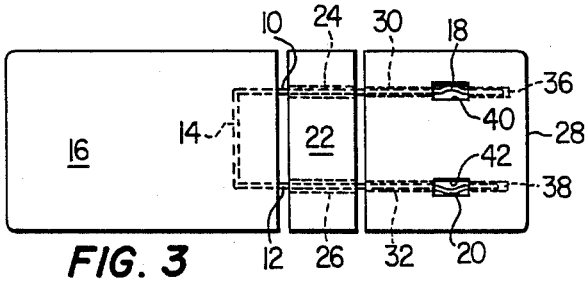
FIG. 3
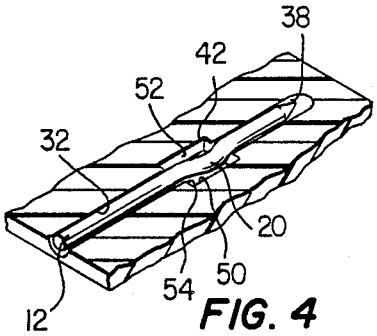
FIG. 4
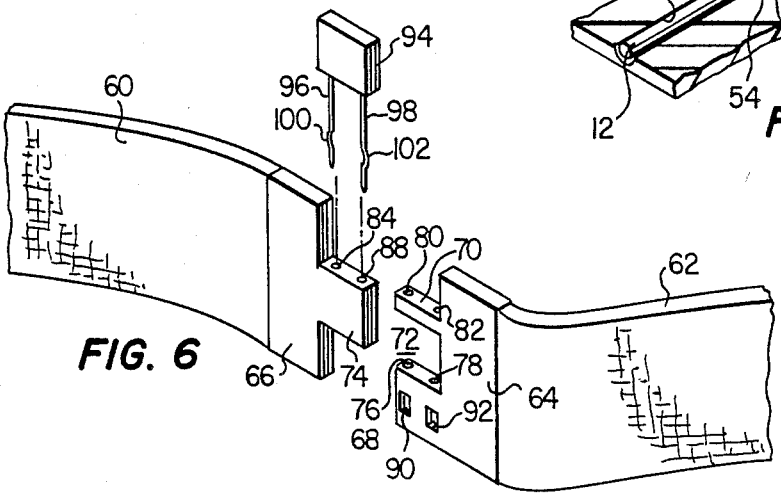
FIG. 6

LOCKING MECHANISM

TECHNICAL FIELD OF THE INVENTION

The present invention pertains in general to locking mechanisms, and, more particularly to a locking mechanism for holding a longitudinal shaft or pin in a longitudinal channel.

BACKGROUND OF THE INVENTION

When utilizing a pin-type mechanism for insertion through fabrics or hair and the such, it is difficult to hold the pin in place, especially when the pin is straight. Typically, when a straight pin has been inserted into fabric to secure something to the fabric or to hold two pieces of fabric together, it has been the practice of some individuals to "kink" the pin after insertion thereof. This makes it less likely to fall out, as there is provided an impediment to the sliding action of the pin. However, this essentially destroys the pin such that it cannot be utilized again. This is due to the fact that an individual cannot control the amount of kinking, nor can an individual determine exactly how much kinking is required to prevent it from falling out of the material.

Other locking systems which have seen some use in the past utilize locking tabs of some sort that are attached to the pin after the pin is inserted in the fabric. The pin is therefore utilized to secure two separate pieces together with the locking tab preventing the removal thereof accidentally or otherwise. This locking tab acts as a "cotter pin." The disadvantage to this type of device is that two pieces are required which can result in problems with respect to using one or the other of the parts. Additionally, one of the parts can become deformed, thus resulting in problems when mating the two parts.

SUMMARY OF THE INVENTION

The present invention disclosed and claimed herein comprises a locking mechanism. The locking mechanism includes a longitudinal rod which has a longitudinal axis with a predetermined diameter. The rod has first and second ends with the first ends secured to one of two workpieces that are to be secured together with the locking mechanism. A channel is formed in the other of the two workpieces to receive the second end of the longitudinal rod. A frictional portion is disposed at the end of the longitudinal rod proximate the second end thereof. The friction portion is operable to increase the effective diameter of the longitudinal rod at the friction portion, which diameter is greater than that of the channel. Upon insertion into the channel, the friction portion provides some resistance to movement therethrough. A cavity is provided in communication with the channel for receiving the friction portion when the longitudinal rod is inserted to its maximum distance within the channel. The cavity has an effective diameter that is greater than the effective diameter of the friction portion, thus removing any frictional relationship between the channel and the longitudinal rod.

BRIEF DESCRIPTION OF THE DRAWINGS

For a more complete understanding of the present invention and the advantages thereof, reference is now made to the following description taken in conjunction with the accompanying Drawings in which:

FIG. 1 illustrates an exploded view of one application of the locking mechanism wherein two parallel pins are utilized;

FIG. 2 illustrates a side cross-sectional view along the longitudinal axis of one of the pins illustrating the mechanism inserted in a cloth article;

FIG. *2a* illustrates a cross-sectional view of an alternate embodiment of FIG. 2.

FIG. 3 illustrates a top view of the mechanism of FIG. 1 with the pins inserted into the locking position;

FIG. 4 illustrates a cut-away view of the kinked portion of the locking pin residing in the strain-relief cavity;

FIG. 5 illustrates a planar view of the locking pin disposed in the channel wherein the kinked portion is disposed in the channel; and FIG. 6 illustrates an example of the use of the locking mechanism for a belt buckle or similar fastening device.

DETAILED DESCRIPTION OF THE INVENTION

Referring now to FIG. 1, there is illustrated a top exploded view of the locking pins illustrated as two parallel locking pins 10 and 12. The pins 10 and 12 are formed from, for example, spring steel by forming a single longitudinal piece of spring steel into a "U" shape or portion. The lower end of the U-portion of the pin is noted by a reference numeral 14, which U-portion 14 is imbedded in a plastic end piece 16 and extending from one end thereof.

Each of the pins 10 and 12 is longitudinal in shape with a tapered and pointed end that is diametrically opposite the end piece 16 and the imbedded U-portion 14. The longitudinal pin 10 has a "kinked" portion 18 disposed on the end thereof and the pin 12 has a kinked portion 20 disposed on the end thereof. The kinked portions 18 and 20 extend outward and in the same plane as the plastic end piece 16.

An intermediate portion 22, fabricated from the same material as the plastic end piece 16, has two channels 24 and 26 disposed therein. The channels 24 and 26 are parallel channels that are disposed a distance away from each other that is equal to the distance between the two parallel pins 10 and 12. The channels 24 and 26 are operable to receive the pointed ends of 10 and 12. As will be described hereinbelow, the channels 24 and 26 have a diameter that is slightly greater than the combined thickness of each of the pins 10 and 12 and the associated kinked portions 18 and 20. The intermediate piece 22 is operable to be slipped over the kinked portions 18 and 20 with little or no friction and slid down on the lower portions of pins 10 and 12 to abut with the plastic end piece 16.

A second end piece 28 is provided which is fabricated from the same material as the end piece 16. Two parallel channels 30 and 32 are provided which are spaced apart the same distance as the channels 24 and 26 and are operable to meet with the channels 24 and 26. The channels 30 and 32 extend from an end surface 34 on the end piece 28, which end surface 34 is operable to abut against the intermediate piece 22. The channels 30 and 32 extend inward to a blind end 36 associated with the channel 30 and a blind end 38 associated with the channel 32. Intermediate between the blind end 36 and the end surface 34 is a strain-relief cavity 40 associated with channel 30 and a strain-relief cavity 42 associated with channel 32.

In operation, the intermediate piece 22 is operable to slip over the ends of the longitudinal pins 10 and 12 with little or no resistance and abut against the plastic end piece 16. The pins 10 and 12 are operable to insert into the channels 30 and 32 and move therethrough until the kinked portions 18 and 20 are disposed in the associated strain-relief cavities 40 and 42. When the kinked portions 18 and 20 traverse both the channels 30 and 32, there is a relatively "snug" fit until the kinked portions 18 and 20 move into the strain-relief cavities 42. In this manner, the pins 10 and 12 rest within a locking position with no strain placed on the kinked portions 18 and 20 of pins 10 and 12, respectively, or any portion of the channels 30 and 32. If not for the strain-relief cavities 40 and 42, the kinked portions 18 would provide a lock but only due to a friction fit within the channels. Since the material utilized is plastic, this plastic would deform after a period of time and the kinked portions 18 and 20 would tend to pull out of the channels. This does not happen with the strain-relief cavities 40 and 42, since they merely provide an impediment to movement in the longitudinal direction of the pins 10 and 12 with no friction fit to cause a deformation of the plastic.

Referring now to FIG. 2, there is illustrated a cross-sectional diagram of the device of FIG. 1 that is inserted in a piece of material 44, wherein like numerals refer to like parts in the various figures. For illustrative purposes, the cross-sectional diagram is taken along pin 10. The material 44 lies underneath the plastic end piece 16 with the pins 10 and 12 inserted through the material 44. The intermediate piece 22 is then inserted over the pins 10 and 12 such that the material 44 is disposed therebetween. The material 44 is then wrapped over the end piece 22 such that the open end of channels 24 and 26 that are diametrically opposite the plastic end piece 16 are covered to allow the material 44 to be draped thereover. The partially inserted pins 10 and 12 are then pushed through the material 44 and then the plastic end piece 28 inserted thereover and pressed tightly against the intermediate piece 22. The appearance from the upper surface shows only the two plastic end pieces separated by the intermediate piece 22. Although shown relatively wide, it should be understood that the thickness of the end piece 22 can be any dimension. Further, the intermediate piece 22 is not required as the material 44 can be bunched to allow insertion of the pin therein. This is illustrated in FIG. 2*a* wherein primed numbers are utilized to refer to various parts.

As can be seen from FIG. 2*a*, the end piece 16' has a protrusion 48 disposed over the end thereof proximate pins 10 and 12. The protrusion butts up against the lower end of the other end piece 28' to slightly cover it. This allows a space between the two end pieces to allow the material 44 to be bunched and the pins inserted therethrough. From the top, it appears to be a closed portion.

Referring now to FIG. 3, there is illustrated a bottom view of the structure of FIG. 1, wherein like numerals refer to like parts in the various figures. It can be seen from this view that the kinked portions 18 and 20 have no impediment in a lateral direction when they reside in the strain-relief cavities 40 and 42. However, it should be noted that the channels 30 and 32 have a width that is slightly less than the combined width of pins 10 and 12 plus the outer surface of kinked portions 18 and 20.

Referring now to FIG. 4, there is illustrative a detailed view of the cavity 42 with the kinked portion 20 of pin 12 residing in the strain-relief cavity 42. The cavity 42 has a width that is greater than the width of the channel 32. However, it should be noted that the channels 24 and 26 are large enough such that the kinked portions 18 and 20, respectfully, pass therethrough very easily and unimpeded.

The strain-relief cavity 42 has an outer protrusion in a lateral direction 50 and an outer protrusion in the inward lateral direction 52. It should be understood that this is merely a design choice and that the only protrusion that is required is the protrusion 50 which is disposed in the direction of the kinked portion 20. It is only necessary that the protrusion 50 be directed in the same direction as the kinked portion 20. For example, if the kinked portion 20 were directed at a 90° angle, this would require the strain-relief cavity 42 also be rotated at approximately 90°. Further, the kinked portion 20 could be replaced by a "bulge" that would require both protrusions 50 and 52 in the strained relief cavity 42. It is important to note that the kinked portions 18 and 20 both go in opposite directions. This is such that when two parallel pins 10 and 12 are utilized, they will not be "biased" to one side or the other.

Referring now to FIG. 5, there is illustrated a cross-sectional view of the pin 12 and the associated kinked portion 20 being inserted partially through channel 32 and into the strain-relief cavity 42. The kinked portion 20 resides within the channel 32 and illustrates the friction fit. It is noted that while the kinked portion 20 resides within the channel 32, a sliding fit is provided, since the outer surface to the kinked portion 20 and the oppositely disposed surfaces of the pin 12 slide along the surface of the channel 32. However, when the kinked portion 20 slides upward into the strain-relief cavity 42, the edge of the cavity, denoted by a reference numeral 54, rests along an angular surface of the kinked portion 20, which surface was not touching the sides during traversal upwards into the strain-relief cavity 42. Therefore, it is desirable that the corner 54 is not rounded, as this will provide more impediment to movement of the kinked portion 20 out of the strain-relief cavity 42.

Referring now to FIG. 6, there is illustrated a frontal view of a belt or similar device utilizing the locking mechanism of the present invention to fasten two ends together. The belt is comprised of a flexible end 60 and a flexible end 62. A first mating portion 64 is provided on the flexible portion 62 and a second mating portion 66 is provided on a flexible portion 60. The mating portions 64 and 66 are operable to co-act with each other such that a portion 64 abuts a portion 66. Mating portion 64 has a lower protrusion 68 extending upward therefrom and an upper protrusion 70 extending outward therefrom. A space 72 is provided between the protrusions 68 and 70. The space 72, in the preferred embodiment, is rectangular shaped. The mating portion 66 has a protrusion 74 extending outward therefrom which is shaped identical to the rectangular shape of the space 72. The protrusion 74 is operable to be inserted into the space 72 between the protrusions 68 and 70.

The protrusion 60 has a channel 76 and a channel 78 formed therein which are perpendicular to the plane of interaction between the two mating portions 64 and 66 and parallel to the plane of the mating portion 64. In a similar manner, the protrusion 70 has a channel 80 and a channel 82 disposed therein which are coaxially aligned with the channels 76 and 78. The protrusion 74 has a channel 84 and a channel 88 which, when the protrusion 74 is disposed within the space 72, are aligned with channels 76 and 78 respectively and channels 80 and 82 respectively. Therefore, when the protrusion 74 is disposed within the space 72, the channel 80, the channel 84 and the channel 76 line up, and the channel 82, the channel 88 and the channel 78 line up. At the lowermost portion of the channels 76 and 78 there are disposed two strain relief cavities 90 and 92, respectively, which are similar to strain relief cavities 40 and 42 in FIGS. 1–4.

A removable portion 94 is provided having two longitudinal pins 96 and 98 extending downward therefrom and in a parallel manner. Pins 96 and 98 are spaced apart the distance of the channels 80 and 82. The longitudinal pins 96 and 98 have pointed ends and kinked portions 100 and 102, respectively on the ends thereof. The longitudinal pins 96 and 98 are similar to pins 10 and 12 in FIGS. 1–4.

In operation, the portion 94 and the longitudinal pins 96 and 98 are inserted into channels 80 and 82 and downward through channels 84 and 88 and through channels 76 and 78 to reside therein such that the kinked portions 100 and 102 reside in the strain relief cavities 90 and 92. Therefore, lateral movement of the mating portion 66 from the mating portion 64 does not cause any motion along the longitudinal axis of the pins 96 and 98, thus providing a secure mate between the two portions 64 and 66.

In summary, there has been provided a locking mechanism which utilizes a longitudinal pin having a kinked portion disposed along the longitudinal axis thereof. The longitudinal pin is inserted into a channel that has a diameter slightly less than the diameter of the pin and associated kinked portion. A strain-relief cavity is disposed at the end of the channel. When the kinked portion traverses the channel, a friction fit results. Upon entering the strain-relief cavity, friction on the pin is relieved to provide a locking action.

Although the preferred embodiment has been described in detail, it should be understood that various changes, substitutions and alterations can be made therein without departing from the spirit and scope of the invention as defined by the appended claims.

What is claimed is:

1. A locking mechanism for securing two semi-resilient workpieces together, comprising:

first and second cylindrical rods each having a longitudinal axis with a predetermined diameter and each having first and second ends with the first end of each of the first and second cylindrical rods secured to one of the two work pieces;

first and second channels formed in the other of the two workpieces for receiving the second ends of each of said longitudinal rods, respectively, and the portion of the said first and second longitudinal rods not remaining exposed such that the two workpieces substantially abut;

first and second longitudinal members each shaped similar to said cylindrical rod and having a sepertine axis with first and second ends with said first and second ends in the same plane and intersecting said longitudinal axis of the respective one of said first and second cylindrical rods at a point removed a predetermined distance from the distal ends thereof and forming an integral part thereof;

the surface of each of said first and second longitudinal members forming an apex at the farthest most point from the respective longitudinal axis and each of the apexes lying in the plane of said first and second cylindrical rods and in diametrically opposite directions;

said first and second channels having a diameter that is slightly less than the distance between the surface of the respective one of said first and second longitudinal members farthest most from said respective longitudinal axis and the surface of said respective first and second cylindrical rods on the diametrically opposite side of said respective longitudinal axis;

first and second cavities in communication with said first and second channels, respectively, for receiving a respective one of said first and second longitudinal members when the second end of said respective first and second cylindrical rods is fully inserted into said channels, each of said cavities having a surface that is parallel with the axis of said respective first and second channels that is disposed a distance away from said respective longitudinal axis that is greater than the distance of the farthest most surface of said longitudinal member, each of said first and second cavities forming a longitudinal dimension that is slightly larger than the respective one of said first and second longitudinal members to provide relief for said first and second longitudinal members when in said respective first and second cavities.

2. The locking mechanism of claim 1 wherein said first and second cylindrical rods are fabricated from spring steel.

3. The locking mechanism of claim 1 wherein the second end of each of said first and second cylindrical rods are tapered to a point at the most distal end of said first and second cylindrical rods proximate the second end.

4. The locking mechanism of claim 1 wherein said first and second channels each have an open end and a blind end, the open end for receiving the second end of the respective one of said first and second cylindrical rods with said respective cavity disposed intermediate between said open end and said blind end.

* * * * *